US009189909B2

(12) United States Patent
Miki et al.

(10) Patent No.: US 9,189,909 B2
(45) Date of Patent: Nov. 17, 2015

(54) BANKNOTE HANDLING APPARATUS

(75) Inventors: Isao Miki, Himeji (JP); Masao Sakamoto, Himeji (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/497,825

(22) PCT Filed: Sep. 25, 2009

(86) PCT No.: PCT/JP2009/066635
§ 371 (c)(1),
(2), (4) Date: Mar. 23, 2012

(87) PCT Pub. No.: WO2011/036764
PCT Pub. Date: Mar. 31, 2011

(65) Prior Publication Data

US 2012/0273321 A1 Nov. 1, 2012

(51) Int. Cl.
*G07F 7/04* (2006.01)
*G07D 11/00* (2006.01)

(52) U.S. Cl.
CPC ..... *G07D 11/0054* (2013.01); *G07D 11/006* (2013.01); *G07D 11/0051* (2013.01); *G07D 11/0072* (2013.01)

(58) Field of Classification Search
CPC ..... G07D 7/00; G07D 7/006; G07D 11/0051; G07D 11/0054; G07D 11/0057; G07D 11/006; G07D 11/0063; G07D 11/0066; G07D 11/0069; G07D 11/0072; G07D 11/0081; G07D 11/0084; G07D 11/0087; G07D 11/009; G07D 11/0093; G07D 11/0096; G07F 19/00; G07F 19/20; G07F 19/201; G07F 19/202; G07F 19/203
USPC ..... 194/206, 207; 209/534; 382/135; 235/379
See application file for complete search history.

(56) References Cited

U.S. PATENT DOCUMENTS 8,783,435 B2 * 7/2014 Matsuura et al. ..... 194/206
2004/0093117 A1 * 5/2004 Daout et al. ..... 700/231
(Continued)

FOREIGN PATENT DOCUMENTS

JP 62-290992 12/1987
JP 02-235192 9/1990
(Continued)

OTHER PUBLICATIONS

English Translation of WO2006040834A1.*

*Primary Examiner* — Jeffrey Shapiro
(74) *Attorney, Agent, or Firm* — Renner, Kenner, Greive, Bobak, Taylor & Weber

(57) ABSTRACT

To provide a banknote handling apparatus (1) capable of reducing a waiting time of a customer, as compared with a case in which a general banknote replenishing operation is performed when a banknote to be dispensed falls short in a dispensing process. The banknote handling apparatus (1) includes a memory unit (32) configured to record the stored-number of banknotes stored in the banknote handling apparatus (1) by denomination. Upon receipt of a command for dispensing a banknote(s) of one or more denominations, the number of dispensing being designated by denomination, the control unit (30) is configured to compare the designated-number with the stored-number recorded in the memory unit (32) corresponding to the denomination designated in the dispensing command, and to control the reception unit (11) and the transport unit (10) such that, if the stored-number is smaller than the designated-number, a banknote is fed out from the reception unit (11) and is recognized by the recognition unit (13), and that a banknote of a designated denomination is transported to the dispensing unit (12), in order that the number of banknotes of the designated denomination that have been transported to the dispensing unit matches the designated-number.

10 Claims, 8 Drawing Sheets

(56) References Cited

U.S. PATENT DOCUMENTS

| | | | | |
|---|---|---|---|---|
| 2004/0182677 | A1 * | 9/2004 | Katou et al. | 194/206 |
| 2008/0060906 | A1 * | 3/2008 | Fitzgerald et al. | 194/207 |

FOREIGN PATENT DOCUMENTS

| | | | |
|---|---|---|---|
| JP | 10-188074 | | 7/1998 |
| WO | WO2006040834 | A1 * | 4/2006 |

* cited by examiner

BANKNOTE HANDLING APPARATUS

FIELD OF THE INVENTION

The present invention relates to a banknote handling apparatus configured to handle a banknote.

BACKGROUND OF THE INVENTION

Various kinds of banknote handling apparatuses configured to handle a banknote have been conventionally known. Among such banknote handling apparatuses, there is known a banknote handling apparatus which includes: a reception unit configured to receive a banknote and to feed out the banknote, one by one; a transport unit configured to transport the banknote fed out from the reception unit in an inside of a housing; and a recognition unit disposed on the transport unit, the recognition unit being configured to recognize at least a denomination of the banknote transported by the transport unit. In addition, there is known a conventional banknote handling apparatus which includes: a storing and feeding unit connected to the transport unit, the storing and feeding unit configured to store a banknote which has been transported from the transport unit, and configured to feed out the stored banknote one by one; and a dispensing unit connected to the transport unit, the dispensing unit being configured to stack a banknote which have been transported from the transport unit, and to enable an operator (e.g., clerk) to take out the banknote.

Further, Patent Document 1 discloses a banknote handling apparatus which replenishes a deficit in general banknotes of a predetermined denomination, which are stored inside, with a new banknote of the predetermined denomination, and dispenses the general banknote(s) of the predetermined denomination and the new banknote(s) of the predetermined denomination, while a sum of the number of the general banknote(s) of the predetermined denomination and the number of the new banknote(s) of the predetermined denomination is designated.

Furthermore, Patent Document 2 discloses a substitute denomination dispensing method in which, while banknotes to be dispensed are being fed out, when a banknote to be dispensed falls short, substitute banknotes of a different denomination are dispensed.

Patent Document 1: JP2000-251123A
Patent Document 2: JP2003-346222A

DISCLOSURE OF THE INVENTION

Generally, a banknote handling apparatus sorts banknotes to be dispensed by denomination, and stores them in a plurality of storing and feeding units. Upon receipt of a dispensing command, the banknote handling apparatus feeds out and dispenses banknotes, the number of which is designated, from the storing and feeding unit of the designated denomination. However, when the number of banknotes stored in the storing and feeding units decreases, there is a possibility that the banknote handling apparatus might not dispense a banknote(s) whose number and denomination are designated by the dispensing command.

In this case, after banknotes of the deficient denomination have been replenished, an operator performs a dispensing process. As the replenishing method, there are a method in which banknotes are put into a reception unit and the banknotes are stored in a storing and feeding unit, and a method in which a banknote handling apparatus is opened and banknotes are directly loaded into a storing and feeding unit, a replenishing cassette and so on. In either conventional methods, since the dispensing process is performed after banknotes have been replenished, there is a problem in that a waiting time of a customer who requests the dispensing process increases.

In addition, in the banknote handling apparatus disclosed in Patent Document 1, general banknotes and new banknotes of the denomination to be dispensed are stored inside, and a deficit in the general banknotes is replenished with the new banknote(s). However, if the number of new banknotes also becomes insufficient, a banknote replenishing process should be performed. In the substitute denomination dispensing method disclosed in Citation 2, banknotes whose denomination is different from the denomination of the insufficient banknote are dispensed in place thereof. However, although this method is effective in that a total sum of banknotes to be dispensed can match a required sum, there is a problem in that the deficit in the number of banknotes of the designated denomination cannot be solved.

Upon receipt of a dispensing command, when banknotes whose denomination and number are designated by the dispensing command cannot be dispensed, there is a case in which a banknote is not dispensed through the banknote handling apparatus, but is directly dispensed from a safe or the like by an operator (clerk). However, when a dispensing process is manually performed by an operator, a counting mistake of banknotes and an inputting mistake of the denomination or the number of the dispensed banknote may occur, so that there is a possibility that account data about a counted result and an actual money amount of the banknotes differ from each other. Thus, even though a waiting time for a customer can be reduced, a dispensing process, which is manually performed and is not through a banknote handling apparatus, is not preferable.

The present invention has been made in view of the above circumstances. The object of the present invention is to provide a banknote handling apparatus which can reduce a waiting time for a customer, as compared with a case in which a general banknote replenishing process is performed, when a banknote to be dispensed falls short in a dispensing process.

A banknote handling apparatus of the present invention is a banknote handling apparatus including: a reception unit configured to receive a banknote and to feed out the banknote one by one; a transport unit configured to transport the banknote fed out from the reception unit; a recognition unit disposed on the transport unit, the recognition unit being configured to recognize at least a denomination of the banknote transported by the transport unit; a storing and feeding unit connected to the transport unit, the storing and feeding unit being configured to store the banknote that has been transported from the transport unit, and to feed out the stored banknote, one by one, to the transport unit; a dispensing unit connected to the transport unit, the dispensing unit being configured to stack the banknote that has been transported from the transport unit, and to enable an operator to take out the banknote; a memory unit configured to record the stored-number of banknotes stored in the banknote handling apparatus by denomination; and a control unit configured to, upon receipt of a command for dispensing a banknote of one or more denominations, the number of dispensing being designated by denomination, compare the designated-number with the stored-number recorded in the memory unit corresponding to the denomination designated in the dispensing command, and to control the reception unit and the transport unit such that, if the stored-number is smaller than the designated-number, a banknote is fed out from the reception unit and is recognized by the recognition unit, and that a banknote of the designated denomination is transported to the dispensing unit, in order that the number of banknotes of the designated denomination that have been transported to the dispensing unit matches the designated-number.

In the banknote handling apparatus of the present invention, the storing and feeding unit may include a plurality of storing and feeding units configured to store banknotes by denomination; and the stored-number of banknotes to be recorded by denomination in the memory unit may be the number of banknotes stored in the storing and feeding unit corresponding to the denomination.

In this case, the control unit may be configured to determine the stored-number of banknotes stored in the storing and feeding unit that is not in operation, out of the respective storing and feeding units by denomination, as 0.

In the banknote handling apparatus of the present invention, the storing and feeding unit may include a plurality of storing and feeding units configured to store banknotes by denomination, and a storing and feeding unit of mixed denominations configured to store banknotes of a plurality of denominations in a mixed state; and the stored-number of banknotes to be recorded by denomination in the memory unit may be a total sum of the number of banknotes stored in the storing and feeding unit corresponding to the denomination, and the number of banknotes of the corresponding denomination stored in the storing and feeding unit of mixed denominations.

In the banknote handling apparatus of the present invention, a banknote to be sent to the dispensing unit upon receipt of the dispensing command may be a banknote of the designated denomination that is stacked in the reception unit.

In the banknote handling apparatus of the present invention, banknotes to be sent to the dispensing unit upon receipt of the dispensing command may be a mixture of a banknote stored in the storing and feeding unit that stores banknotes corresponding to the designated denomination, and a banknote of the designated denomination that is stacked in the reception unit.

In the banknote handling apparatus of the present invention, after the number of banknotes of the designated denomination that had been transported to the dispensing unit has matched the designated-number, the control unit may be configured to return a banknote received by the reception unit.

In the banknote handling apparatus of the present invention, after the number of banknotes of the designated denomination that had been transported to the dispensing unit has matched the designated-number, the control unit may be configured to feed out a banknote received by the reception unit, to recognize the banknote by the recognition unit, and to store the banknote in the storing and feeding unit.

A banknote handling apparatus of the present invention is a banknote handling apparatus including: a reception unit configured to receive a banknote and to feed out the banknote one by one; a transport unit configured to transport the banknote fed out from the reception unit; a recognition unit disposed on the transport unit, the recognition unit being configured to recognize at least a denomination of the banknote transported by the transport unit; a storing and feeding unit connected to the transport unit, the storing and feeding unit being configured to store the banknote that has been transported from the transport unit, and to feed out the stored banknote, one by one, to the transport unit; a dispensing unit connected to the transport unit, the dispensing unit being configured to stack the banknote that has been transported from the transport unit, and to enable an operator to take out the banknote; a memory unit configured to record a denomination of a banknote allowed to be stored in the banknote handling apparatus; and a control unit configured to, upon receipt of a command for dispensing a banknote whose number is designated, a denomination of the banknote to be dispensed being different from the denomination of a banknote allowed to be stored, to feed out a banknote from the reception unit, to recognize the banknote by the recognition unit, and to transport a banknote of the denomination designated in the dispensing command to the dispensing unit, in order that the number of banknotes of the designated denomination that have been transported to the dispensing unit matches the designated-number.

In the banknote handling apparatus of the present invention, when a banknote is fed out from the reception unit and recognized by the recognition unit upon receipt of the dispensing command, the control unit may be configured to store a banknote whose denomination is other than the designated denomination in the feeding and storing unit, and to transport the banknote whose denomination is other than the designated denomination stored in the storing and feeding unit, to the dispensing unit, after the dispensing process has been finished.

DETAILED DESCRIPTION OF THE INVENTION

First Embodiment

A first embodiment of the present invention will be described herebelow with reference to the drawings. FIGS. 1 to 5B are views showing a banknote handling apparatus in this embodiment.

Figure 1:
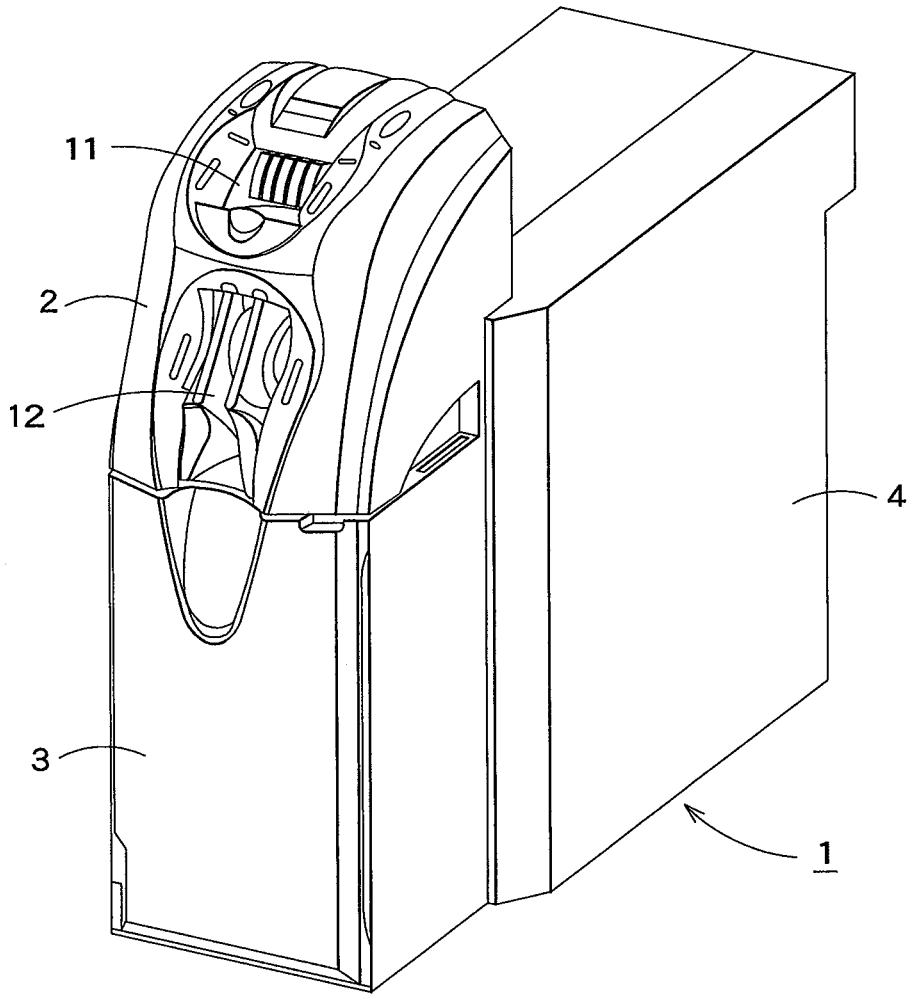
FIG. 1 is a schematic perspective view of a banknote handling apparatus in one embodiment of the present invention.
Figure 2:
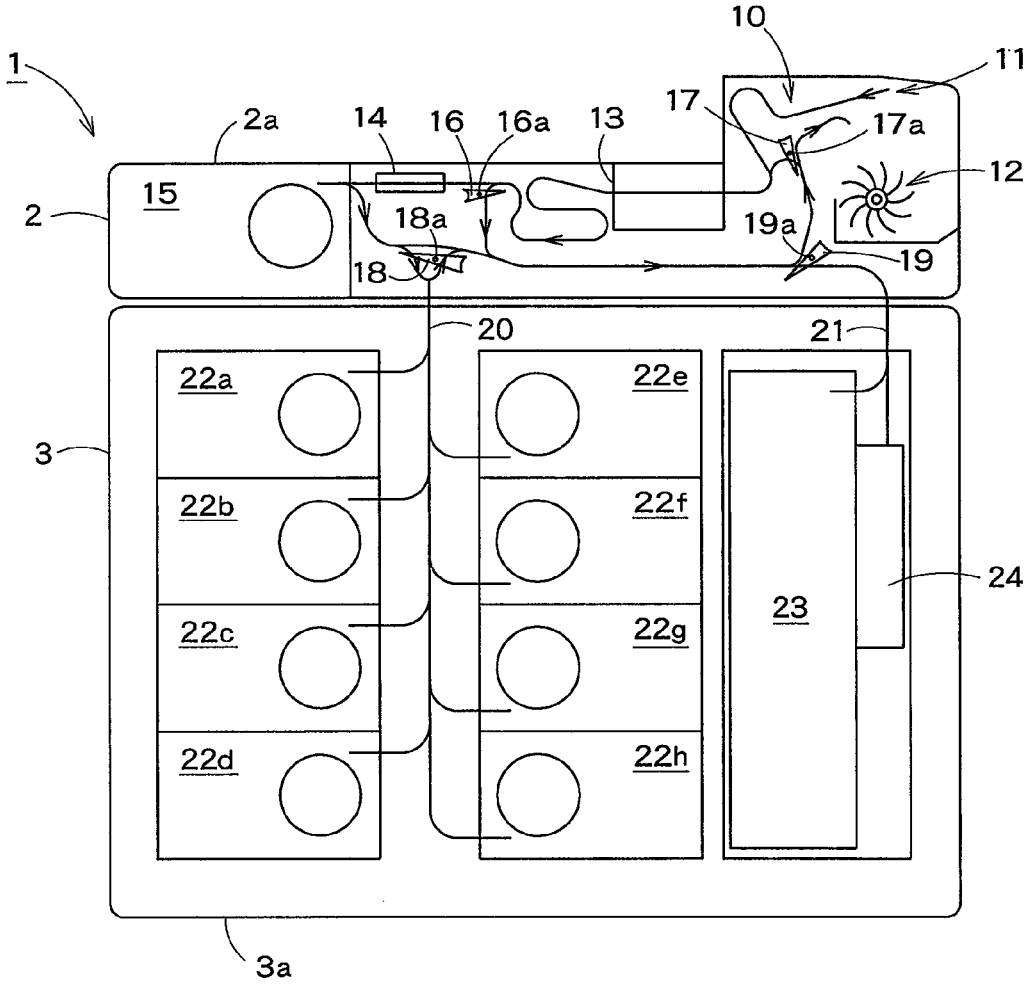
FIG. 2 is a structural view showing an inside structure of the banknote handling apparatus shown in FIG. 1.

As shown in FIGS. 1 and 2, a banknote handling apparatus 1 includes an upper unit 2, a lower unit 3, and an accommodating case 4 for accommodating rear parts of the respective upper unit 2 and the lower unit 3. The upper unit 2 and the lower unit 3 can be respectively drawn forward (a front side in FIG. 1) from the accommodating case 4.

As shown in FIG. 2, the upper unit 2 includes a housing 2*a*. An upper transport unit 10 for transporting a banknote is disposed inside the housing 2*a*. Provided on one end of the upper transport unit 10 is a reception unit 11 configured to receive a banknote from outside and to feed out the banknote one by one. Provided on the other end of the upper transport unit 10 is a dispensing unit 12 configured to stack a banknote which has been transported from the upper transport unit 10, and to enable an operator to take out the banknote. The reception unit 11 is configured to feed out one or a plurality of banknotes, which has been put into the reception unit 11, one by one, to the upper transport unit 10. In the upper transport unit 10 between the reception unit 11 and the dispensing unit 12, a recognition unit 13, a serial-number reading unit 14 and an escrow unit 15 are disposed in this order from an upstream side.

The lower unit 3 includes a housing 3*a*. Lower transport units 20 and 21 for transporting a banknote are disposed inside the housing 3*a*. The lower transport units 20 and 21 are respectively connected to the upper transport unit 10. A plurality of storing and feeding units 22*a* to 22*h* are connected in parallel to the lower transport unit 20. Each of the storing and feeding units 22*a* to 22*h* is configured to store a banknote which has been sent from the lower transport unit 20, and to feed out the stored banknote, one by one, to the lower transport unit 20. In addition, connected to the lower transport unit 21 are a collecting cassette 23 to which a banknote to be collected is sent, and a capture bin 23 in which banknotes are stored in a stacking manner.

The respective constituent elements of the upper unit 2 and the lower unit 3 of the banknote handling apparatus 1 are described in detail below.

The reception unit 11 disposed on the upper unit 2 of the banknote handling apparatus 1 is configured to feed out a plurality of banknotes, which have been set in a batch state in the reception unit 11 in a depositing process, one by one, to the upper transport unit 10. The recognition unit 13 is configured to recognize a denomination, an authenticity and a fitness of a banknote that is being transported by the upper transport unit 10.

The serial-number reading unit 14 is provided for reading a serial number of a banknote that is being transported by the upper transport unit 10. The escrow unit 15 is configured to sequentially store banknotes temporarily, which have passed through the serial-number reading unit 14, and to send the temporarily stored banknotes to the upper transport unit 10. The escrow unit 15 is formed of, e.g., a unit of a tape reeling type, in which banknotes separated apart from each other are sandwiched between a pair of elongate tapes. By reeling up the banknotes together with the pair of tapes around a roller, the plurality of banknotes can be escrowed in the escrow unit 15.

The dispensing unit 12 is provided for discharging, when a banknote is dispensed, a banknote which has been sent from the lower unit 3, or for returning a banknote, which has been recognized as a reject banknote or a counterfeit banknote by the recognition unit 13, to an operator. As described above, the dispensing unit 12 is configured to stack a banknote, which has been transported from the upper transport unit 10, and to enable an operator to take out the banknote.

The upper transport unit 10 is configured to transport a banknote, which has been fed out from the reception unit 11 to the recognition unit 13, and to transport a banknote, which has been judged as a genuine note, to the lower unit 3 via the serial-number reading unit 14 and the escrow unit 15. In addition, the upper transport unit 10 is configured to transport a banknote which has been sent from the lower unit 3 in a banknote dispensing process, or a banknote which could not be judged by the recognition unit 13 in a banknote depositing process, to the dispensing unit 12.

The upper transport unit 10 is provided with diverters 16 to 19 for determining a transport route of a banknote transported by the upper transport unit 10. The respective diverters 16 to 19 are disposed on diverged locations in transport channels of the upper transport unit 10, and are configured to be rotated about shafts 16*a* to 19*a*, respectively. Since orientations of the diverters 16 to 19 are controlled by a control unit 30, which will be described below, these diverters 16 to 19 are configured to shift one transport channel to the other transport channel, such that a banknote transported to the certain diverged position is sent to the other transport channel.

As shown in FIG. 1, a diverged channel is diverged downward from a part of the upper transport unit 10 between the escrow unit 15 and the dispensing unit 12, and the diverged channel is connected to the lower transport unit 20 of the lower unit 3. The diverter 18 provided on this diverged position is configured to shift the transport channels as to whether a banknote fed out from the escrow unit 15 to the upper transport unit 10 is sent to the lower transport unit 20 of the lower unit 3 or not, and to shift the transport channels as to whether a banknote transported from the lower transport unit 20 is sent to the escrow unit 15 or the dispensing unit 12.

Among the eight storing and feeding units 22*a* to 22*h*, the seven storing and feeding units 22*a* to 22*g* are configured to store banknotes by denomination. On the other hand, the storing and feeding unit 22*h* is configured to store banknotes of a plurality of denominations in a mixed state. Each of the storing and feeding units 22*a* to 22*h* is configured to store banknotes sent from the lower transport unit 20, and to feed out the stored banknotes to the lower transport unit 20. To be more specific, each of the storing and feeding units 22*a* to 22*h* is formed of, e.g., a unit of a tape reeling type, in which banknotes separated apart from each other are sandwiched between a pair of elongate tapes. By reeling up the banknotes together with the pair of tapes around a roller, the plurality of banknotes can be escrowed in each of the storing and feeding units 22*a* to 22*h*. However, not limited to the aforementioned tape reeling type, the respective storing and feeding units 22*a* to 22*h* may have another structure. For example, the respective storing and feeding units 22*a* to 22*h* may be of a stacker type (banknotes are stored in a stacking manner).

The lower transport unit 20 is configured to receive a banknote, which has been recognized as a genuine note by the recognition unit 13, from the upper transport unit 10 of the upper unit 2, and to transport the banknote to the storing and feeding unit 22*a* to 22*g* corresponding to the denomination thereof. At this time, when the storing and feeding unit 22*a* to 22*g* corresponding to the denomination of the recognized banknote is full, the banknote is transported to the storing and feeding unit 22*h* of mixed denominations. In addition, the lower transport unit 20 is configured to transport a banknote fed out from the respective storing and feeing units 22*a* to 22*h*, to the upper transport unit 10 of the upper unit 2.

The lower transport unit 21 is configured to receive a banknote which has been recognized as an unfit banknote by the recognition unit 13, and a banknote which was not stored in the storing and feeding units 22*a* to 22*h*, and to transport the banknote to the collecting cassette 23. Specifically, for example, when both the storing and feeding unit 22*a* to 22*g* corresponding to the denomination of the recognized banknote and the storing and feeding unit 22*h* of mixed denominations are full, or when the storing and feeding units 22*a* to 22*h* are intended to be emptied out, a banknote is sent to the collecting cassette 23. A banknote, which has been recognized as a counterfeit banknote, is transported from the lower transport unit 21 to the capture bin 24.

Figure 3:
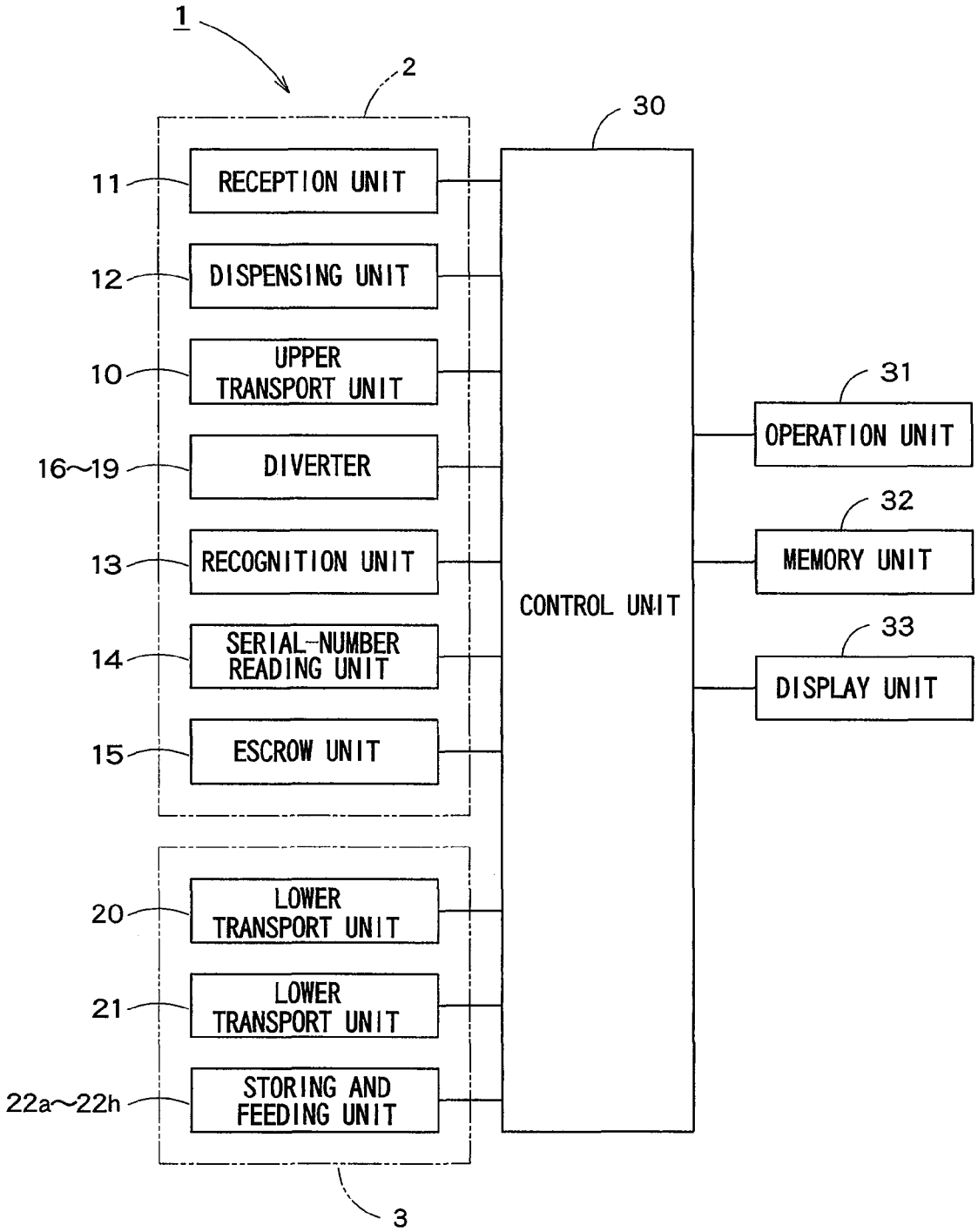
FIG. 3 is a control block diagram of the banknote handling apparatus shown in FIGS. 1 and 2.

As shown in FIG. 3, the banknote handling apparatus 1 is provided with the control unit 30. The control unit 30 is respectively connected to the upper transport unit 10, the reception unit 11, the recognition unit 13, the serial-number reading unit 14, the escrow unit 15 and the diverters 16 to 19 of the upper unit 2, and is respectively connected to the lower transport unit 20, the lower transport unit 21 and the respective storing and feeding units 22*a* to 22*h* of the lower unit 3. Recognition information of a banknote recognized by the recognition unit 13, and information of a serial number of a banknote read by the serial-number reading unit 14, are transmitted to the control unit 30. In addition, the control unit 30 is configured to control the upper transport unit 10, the reception unit 11, the escrow unit 15, the respective diverters 16 to 19, the lower transport unit 20, the lower transport unit 21, the respective storing and feeding units 22*a* to 22*h*, and so on.

In addition, an operation unit 31, a memory unit 32 and a display unit 33 are connected to the control unit 30. The operation unit 31 is used when an operator gives a command to the control unit 30. The operator can transmit various commands to the control unit 30 through the operation unit 31.

The memory unit 32 is configured to record the number of banknotes stored in the banknote handling apparatus 1 (stored-number) by denomination. In more detail, the stored-number of banknotes to be recorded by denomination in the memory unit 32 is a total sum of the number of banknotes stored in the storing and feeding unit 22*a* to 22*g* by denomination corresponding to the denomination, and the number of banknotes of the corresponding denomination stored in the storing and feeding unit 22*h* of mixed denominations. If the storing and feeding unit 22*h* of mixed denominations is not provided, and only the storing and feeding units 22*a* to 22*g* by denomination are provided, the stored-number of banknotes to be recorded by denomination in the memory unit 32 is the number of banknotes stored in the storing and feeding unit 22*a* to 22*g* by denomination corresponding to the denomination. The control unit 30 is configured to perform a control in which the stored-number of banknotes stored in the storing and feeding unit that is not in operation, out of the respective feeding and storing units 22*a* to 22*h* is regarded as 0. To be more specific, the memory unit 32 records the machine number of the broken feeding and storing unit 22*a* to 22*h*, and the control unit 30 performs a control excluding the storing and feeding unit 22*a* to 22*h* of this machine number.

The display unit 33 is configured to display banknote processing conditions in the banknote handling apparatus 1 (specifically, e.g., the stored-number of banknotes stored in the banknote handling apparatus 1 by denomination).

Next, an operation of the above-described banknote handling apparatus 1 is described. The below operation of the banknote handling apparatus 1 is performed by controlling the respective constituent elements of the banknote handling apparatus 1 by the control unit 30.

Figure 4:
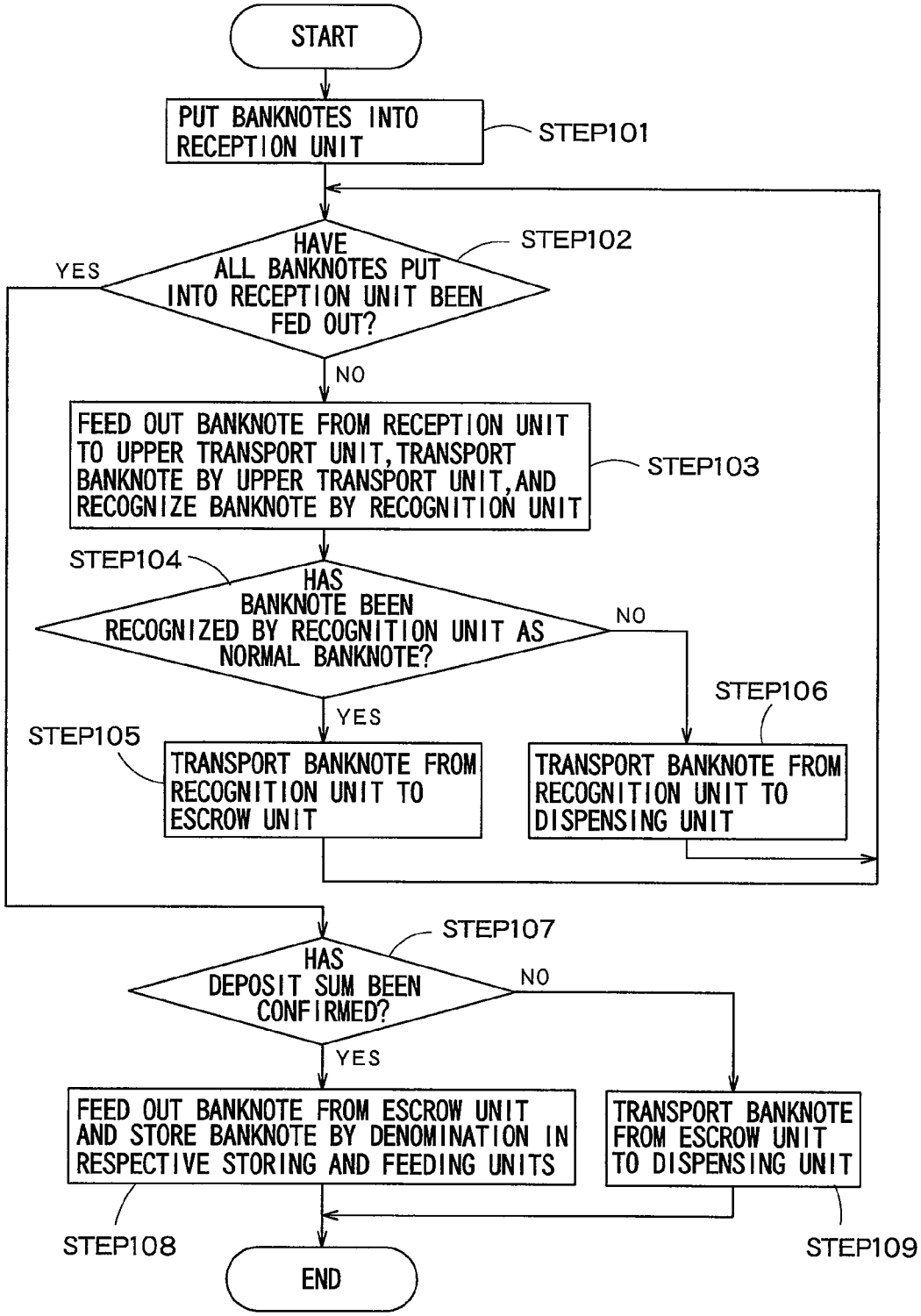
FIG. 4 is a flowchart showing a banknote depositing process in the banknote handling apparatus shown in FIGS. 1 to 3.

In the first place, a depositing process in the banknote handling apparatus 1 is described with the use of a flowchart shown in FIG. 4.

As shown in STEP 101, an operator firstly puts a batch of banknotes to the reception unit 11 of the banknote handling apparatus 1. Then, when the operator presses down a start button disposed on the operation unit 31, the banknotes are fed out, one by one, from the reception unit 11 to the upper transport unit 10, and the banknotes are transported by the upper transport unit 10. The banknotes transported by the upper transport unit 10 are recognized by the recognition unit 13 for a denomination, an authenticity and a fitness (STEP 103). A banknote, which has been recognized as a normal banknote by the recognition unit 13 ("YES" in STEP 104), is transported by the upper transport unit 10 to the escrow unit 15, and is escrowed in the escrow unit 15 (STEP 105). On the other hand, a banknote, which has been recognized as a counterfeit banknote by the recognition unit 13 or could not be recognized by the recognition unit 13 ("NO" in STEP 104), is transported, as a reject banknote, by the upper transport unit 10 to the dispensing unit 12 (STEP 106), and then the operator takes out the reject banknote from the dispensing unit 12.

After all the banknotes put into the reception unit 11 have been fed out and transported to the escrow unit 15 or the dispensing unit 12 ("YES" in STEP 102), if the operator confirms a displayed sum (or the number of banknotes) and presses down a determination key ("YES" in STEP 107), a banknote is fed out, one by one, from the escrow unit 15, and the fed-out banknote is stored in the respective storing and feeding units 22*a* to 22*h* (STEP 108). To be specific, a banknote fed out from the escrow unit 15 is sent to the storing and feeding unit 22*a* to 22*g* corresponding to the denomination of the banknote. When the storing and feeding unit 22*a* to 22*g* corresponding to the denomination of the fed-out banknote is full, the banknote is sent to the storing and feeding unit 22*h* so as to be stored in the storing and feeding unit 22*h* in a mixed denomination state. If the storing and feeding unit 22*h* of mixed denominations is also full, the banknote is transported to the collecting cassette 23 so as to be stored in the collecting cassette 23. In this manner, the depositing process in the banknote handling apparatus 1 is finished. On the other hand, after all the banknotes put into the reception unit 11 have been fed out and transported to the escrow unit 15 or the dispensing unit 12 ("YES" in STEP 102), if the operator presses down a return key ("NO" in STEP 107), a banknote is sent from the escrow unit 15 to the dispensing unit 12, and the banknote is returned to the outside (STEP 109).

Figure 5A:
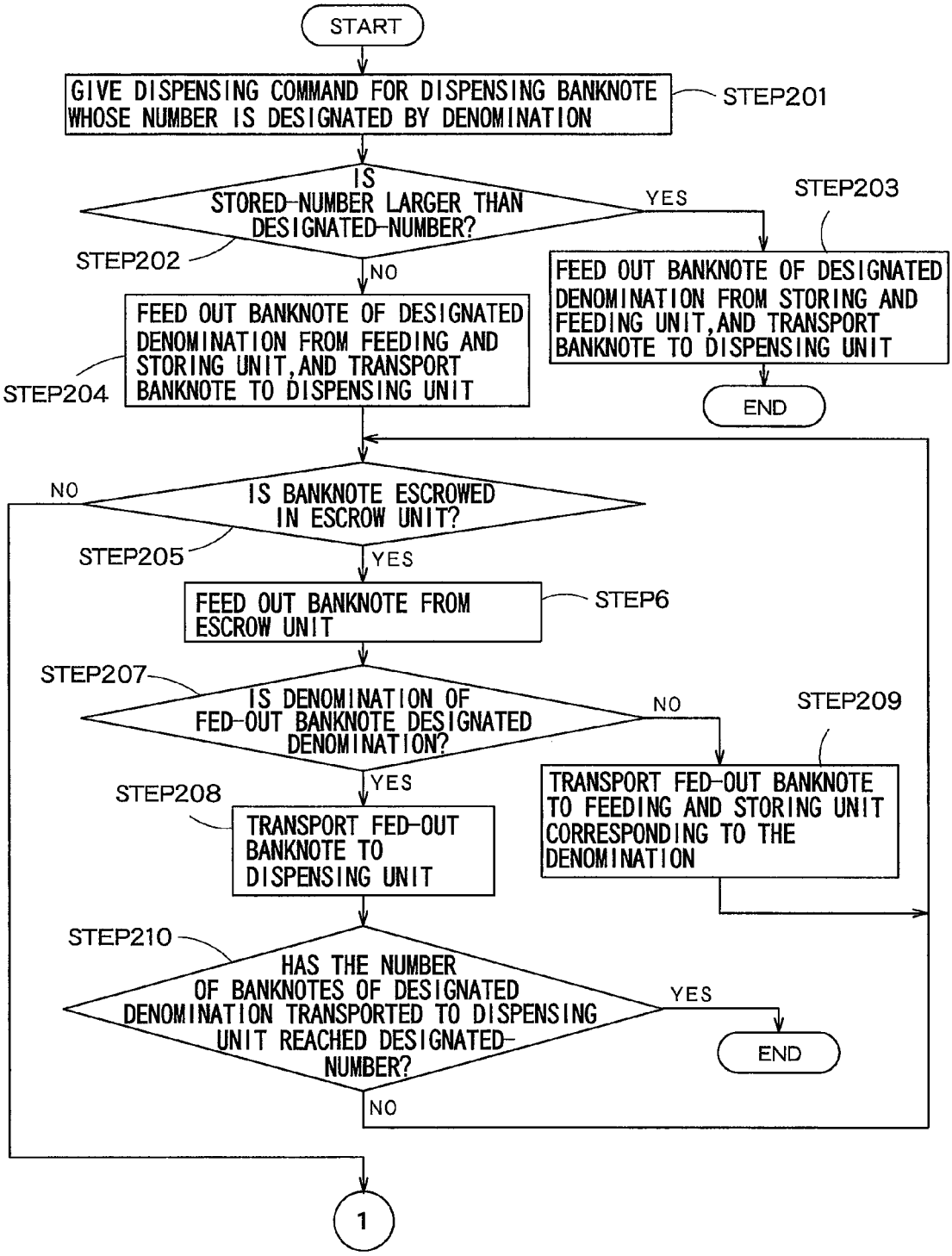
FIG. 5A is a flowchart showing the banknote dispensing process in the banknote handling apparatus shown in FIGS. 1 to 3.
Figure 5B:
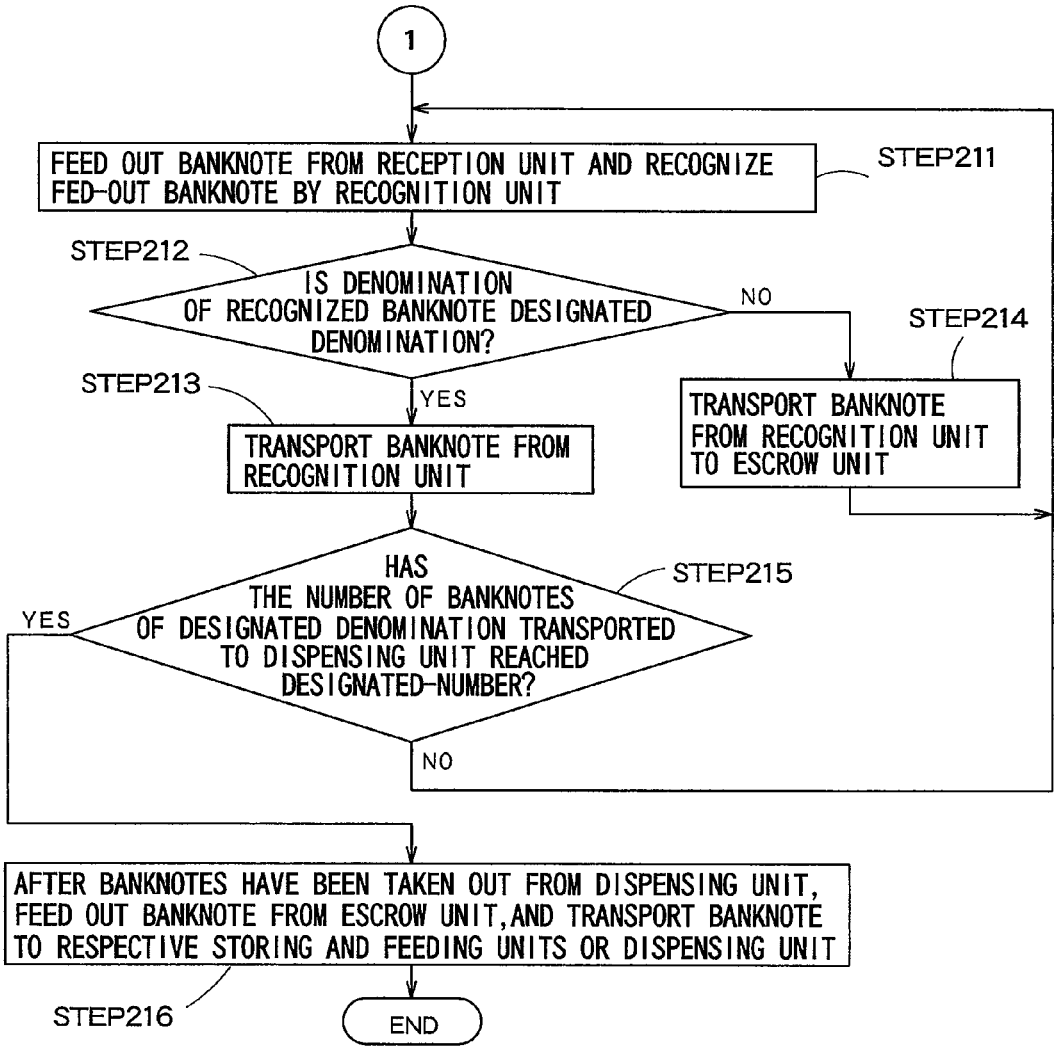
FIG. 5B is a flowchart showing the banknote dispensing process in the banknote handling apparatus shown in FIGS. 1 to 3.

Next, a dispensing process in the banknote handling apparatus 1 is described with the use of a flowchart shown in FIG. 5A and FIG. 5B.

At first, the operator gives a dispensing command to the control unit 30 through the operation unit 31. Specifically, the operator designates, as to banknotes of one or more denominations, the number of banknotes to be dispensed by denomination (STEP 201). In the dispensing command, a denomination of a banknote to be dispensed and a sum of a banknote to be dispensed may be designated, instead of designating the number of banknotes by denomination. In this case, in the control unit 30, a sum of a banknote to be dispensed in the dispensing command is automatically converted to the number of banknotes by denomination. Then, when the operator presses down the start button disposed on the operation unit 31, the control unit 30 judges whether the number of stored banknotes (stored-number) recorded in the memory unit 32 is larger than the designated-number of banknotes (designated-number) or not, for each denomination in the dispensing command (STEP 202). If the stored-number is larger than the designated-number ("YES" in STEP 202), a banknote of the designated denomination is fed out from the respective storing and feeding units 22*a* to 22*h*, and is transported to the dispensing unit 12 (STEP 203). At this time, the transport of banknotes from the respective storing and feeding units 22*a* to 22*h* to the dispensing unit 12 is performed, until the number of banknotes of the designated denomination, which have been transported to the dispensing unit 12, reaches the designated-number in the dispensing command.

On the other hand, if the stored-number is smaller than the designated-number ("NO" in STEP 202), a banknote of the designated denomination is fed out from the respective storing and feeding units 22*a* to 22*g*, and is transported to the dispensing unit 12 (STEP 204). In this case, the number of banknotes of the designated denomination, which have been transported to the dispensing unit 12, falls short of the designated-number in the dispensing command. Then, the control unit 30 judges whether a banknote is escrowed in the escrow unit 15 or not (STEP 205). If a banknote is escrowed in the escrow unit 15 ("YES" in STEP 205), the banknote escrowed in the escrow unit 15 is regarded as a replenishment banknote, and the banknote is fed out, one by one, from the escrow unit (STEP 206). Then, if a denomination of the fed-out banknote is the designated denomination in the dispensing command ("YES" in STEP 207), the fed-out banknote is transported to the dispensing unit 12 (STEP 208). On the other hand, if a denomination of the fed-out banknote is not the designated banknote in the dispensing command ("NO" in STEP 207), the fed-out banknote is transported to the storing and feeding unit 22*a* to 22*g* corresponding to the denomination of the banknote, or to the storing and feeding unit 22*h* of mixed denominations (STEP 209). Then, if the number of banknotes of the designated denomination, which have been transported to the dispensing unit 12, reaches the designated-number ("YES" in STEP 210), the banknote dispensing process is finished. In this case, after the banknote dispensing process has been finished, a banknote is fed out, one by one, from the escrow unit 15, and the fed-out banknote is transported to the storing and feeding unit 22*a* to 22*g* corresponding to the denomination or to the storing and feeding unit 22*h* of mixed denominations.

If no banknote is escrowed in the escrow unit 15 or if the number of banknotes of the designated denomination, which have been transported to the dispensing unit 12, does not reach the designated-number although all the banknotes have been fed out from the escrow unit 15 ("NO" in STEP 205), a banknote received in the reception unit 11 is regarded as a replenishment banknote, and is used as a banknote to be dispensed in the dispensing process. In this case, the display unit 33 displays a message to the operator, which promotes putting of banknotes into the reception unit 11. Then, the operator puts banknotes into the reception unit 11, and the operator presses down the start button disposed on the operation unit 31. Then, a banknote is fed out, one by one, from the reception unit 11, and the fed-out banknote is recognized by the recognition unit 13 (STEP 211). If a denomination of the recognized banknote is the designated denomination ("YES" in STEP 212), the banknote is transported from the recognition unit 13 to the dispensing unit 12. On the other hand, if the denomination of the recognized banknote is not the designated denomination ("NO" in STEP 212), the banknote is transported from the recognition unit 13 to the escrow unit 15 (STEP 214). At this time, a banknote, which has been recognized as a reject banknote by the recognition unit 13, is also transported o the escrow unit 15. Then, if the number of banknotes of the designated denomination, which have been transported to the dispensing unit 12, reaches the designated-number ("YES" in STEP 215), the banknote dispensing process is finished.

After the banknote dispensing process has been finished and the banknotes to be dispensed have been taken out from the dispensing unit 12, a banknote is fed out, one by one, from the escrow unit 15. A normal banknote out of the fed-out banknotes is transported to the storing and feeding unit 22*a* to 22*g* corresponding to the denomination or the storing and feeding unit 22*h* of mixed denominations, so as to be stored in the storing and feeding unit 22*a* to 22*h*. On the other hand, a reject banknote out of the banknotes fed out from the escrow unit 15 is transported to the dispensing unit 12, and the reject banknote is returned to the outside (STEP 216).

If all the banknotes are fed out from the reception unit 11 and a banknote of the designated denomination out of the fed-out banknotes is transported to the dispensing unit 12 but the number of banknotes of the designated denomination, which have been transported to the dispensing unit 12, does not reach the designated-number, the display unit 33 displays a message informing this. In addition, the display unit 33 displays a message to the operator, which promotes further putting of a banknote(s) into the reception unit 11.

According to the banknote handling apparatus 1 in this embodiment, the memory unit 32 is configured to record the stored-number of banknotes stored in the banknote handling apparatus 1 by denomination. Upon receipt of a command for dispensing a banknote(s) of one or more denominations, the number of dispensing being designated by denomination (STEP 201), the control unit 30 compares the designated-number with the stored-number recorded in the memory unit 32 corresponding to the denomination designated in the dispensing command (STEP 202). When the stored-number is smaller than the designated-number ("NO" in STEP 202), a banknote is fed out from the reception unit 11, and is recognized by the recognition unit 13 (STEP 211). Then, a banknote of the designated denomination is transported to the dispensing unit 12 (STEP 213), so that the number of banknotes of the designated denomination, which have been transported to the dispensing unit 12, matches the designated-number ("YES" in STEP 215). According to such a banknote handling apparatus 1, when the number of banknotes of a designated denomination in a dispensing command is larger than the number of banknotes of this designated denomination, which are stored in the banknote handling apparatus 1, there is performed an immediate replenishing and dispensing operation in which a banknote, which has been replenished from outside the banknote handling apparatus 1 (a banknote which has been put into the reception unit 11), is directly dispensed. Therefore, as compared with a case in which a general banknote replenishing operation is performed when a banknote to be dispensed falls short, a waiting time of an operator can be reduced. This is because, due to the aforementioned method, a replenishing process and a dispensing process can be performed in the same step. In addition, according to the above banknote handling apparatus 1, since the number of all the banknotes transported to the dispensing unit 12 is counted by the recognition unit 13 of the banknote handling apparatus 1, it can be prevented that account data about a counted result and an actual money amount of the banknotes differ from each other.

In the banknote handling apparatus 1 in this embodiment, banknotes to be sent to the dispensing unit 12 upon receipt of a dispensing command are a mixture of a banknote stored in the storing and feeding unit 22*a* to 22*h* (STEP 204), a banknote of a designated denomination escrowed in the escrow unit 15 (STEP 208), and a banknote of the designated denomination stacked in the reception unit 11 (STEP 213).

However, banknotes to be sent to the dispensing unit 12 upon receipt of a dispensing command are not limited to the above example. As an alternative example, banknotes to be sent to the dispensing unit 12 upon receipt of a dispensing command may be a mixture of only a banknote stored in the storing and feeding unit 22*a* to 22*h* (STEP 204), and a banknote stacked in the reception unit 11 (STEP 213). In this case, even when the dispensing command has been given, a banknote escrowed in the escrow unit 15 will not be sent to the dispensing unit 12. As a further alternative example, banknotes to be sent to the dispensing unit 12 upon receipt of a dispensing command may be only a banknote of a designated denomination stacked in the reception unit 11 (STEP 213). In this case, even when the dispensing command has been given, a banknote stored in the storing and feeding unit 22*a* to 22*h* will not be sent to the dispensing unit 12.

In addition, in the banknote handling apparatus 1 in this embodiment, the control unit 30 may perform a control in which, after the number of banknotes of a designated denomination, which have been transported to the dispensing unit 12, has matched a designated-number (STEP 215), a banknote received in the reception unit 11 is fed out from the reception unit 11, recognized by the recognition unit 13, and stored in the storing and feeding unit 22*a* to 22*h*. Alternatively, after the number of banknotes of the designated denomination, which have been transported to the dispensing unit 12, has matched the designated-number, the control unit 30 may perform another control. Specifically, for example, after the banknote dispensing process has been finished and banknotes have been taken out from the dispensing unit 12, the control unit 30 may perform a control in which a banknote received by the reception unit 11 is directly transported to the dispensing unit 12, so that the banknote is returned.

The banknote handling apparatus 1 in this embodiment is not limited to the above embodiment, but can be variously modified. For example, in place of the collecting cassette 23, a replenishing and collecting cassette for replenishing the banknote handling apparatus 1 with a banknote may be used. To be specific, a banknote can be sent from the lower transport unit 21 to the replenishing and collecting cassette, and the banknote can be fed out from the replenishing and collecting cassette to the lower transport unit 21. When the banknote handling apparatus 1 is replenished with a banknote by the replenishing and collecting cassette, a banknote is fed out from the replenishing and collecting cassette to the lower transport unit 21. The fed-out banknote is recognized by the recognition unit 13. A normal banknote out of the banknotes recognized by the recognition unit is transported to the escrow unit 15, and a banknote other than the normal banknote is transported to the dispensing unit 12. After all the banknotes have been fed out from the replenishing and collecting cassette, a banknote is fed out from the escrow unit 15, and the fed-out banknote is stored in the storing and feeding unit 22*a* to 22*g* corresponding to the denomination or the storing and feeding unit 22*h* of mixed denominations.

In addition, it is possible to further add, to the stored-number of banknotes recorded by denomination in the memory unit 32, the number of banknotes of a corresponding denomination out of banknotes of a plurality of denominations escrowed in the escrow unit 15. At this time, the stored-number of banknotes recorded by denomination in the memory unit 32 is a total sum of the number of banknotes stored in the storing and feeding unit 22*a* to 22*g* by denomination corresponding to the denomination, the number of banknotes of the corresponding denomination stored in the storing and feeding unit 22*h* of mixed denominations, and the number of banknotes of the corresponding denomination escrowed in the escrow unit 15. In this case, the escrow unit 15 is regarded as a kind of storing and feeding unit which is configured to store banknotes of mixed denominations and to feed out the stored banknotes.

Figure 6:
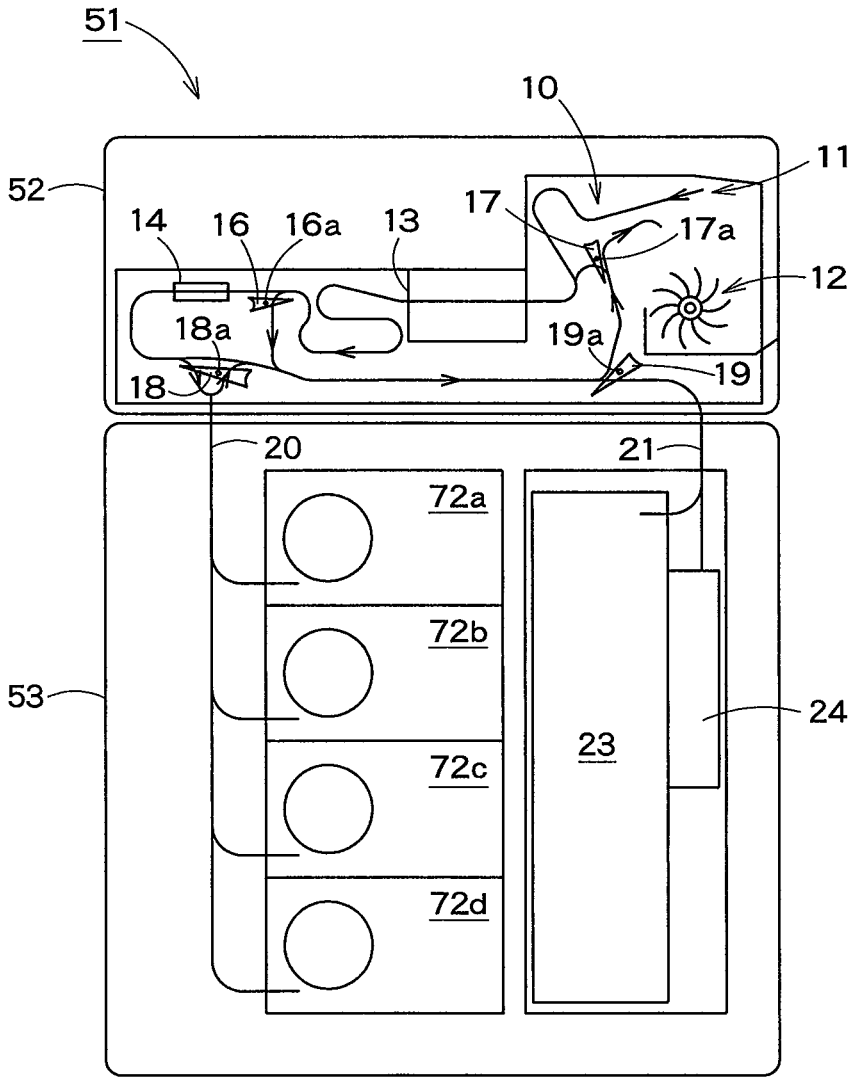
FIG. 6 is a structural view showing an inside structure of the banknote handling apparatus in another embodiment of the present invention.

In addition, the banknote handling apparatus in this embodiment may not have an escrow unit for escrowing a banknote. FIG. 6 is a structural view showing an inside structure of a banknote handling apparatus not having an escrow unit.

The banknote handling apparatus 51 shown in FIG. 6 mainly differs from the banknote handling apparatus 1 shown in FIGS. 1 to 3 in that the banknote handling apparatus 51 is not provided with the escrow unit 15. The other structures of the banknote handling apparatus 51 are similar to those of the banknote handling apparatus 1 shown in FIGS. 1 to 3. The same constituent elements of the banknote handling apparatus 51 shown in FIG. 6 as those of the banknote handling apparatus 1 shown in FIGS. 1 to 3 are shown by the same reference numbers, and detailed description thereof is omitted.

As described above, an upper unit 52 of the banknote handling apparatus 51 is not provided with the escrow unit 15 of the banknote handling apparatus 1 shown in FIGS. 1 to 3. However, the other constituent elements of the upper unit 2 of the banknote handling apparatus 1 shown in FIGS. 1 to 3 are disposed on the upper unit 52 of the banknote handling apparatus 51.

Four storing and feeding units 72*a* to 72*d* are disposed in a lower unit 53 of the banknote handling apparatus 51. Specifically, the four storing and feeding units 72*a* to 72*d* are connected in parallel to the lower unit transport unit 20 of the lower unit 53. These four storing and feeding units 72*a* to 72*d* are configured to store banknotes by denomination. Each of the storing and feeding units 72*a* to 72*d* is configured to store a banknote sent from the lower transport unit 20, and to feed out the stored banknote, one by one, to the lower transport unit 20. To be more specific, each of the storing and feeding units 72*a* to 72*d* is formed of, e.g., a unit of a tape reeling type, in which banknotes separated apart from each other are sandwiched between a pair of elongate tapes. By reeling up the banknotes together with the pair of tapes around a roller, the plurality of banknotes can be escrowed in each of the storing and feeding units 72*a* to 72*d*. Namely, the lower unit 53 is not provided with a storing and feeding unit of mixed denominations.

The other constituent elements of the lower unit 3 of the banknote handling apparatus 1 shown in FIGS. 1 to 3 are disposed in the lower unit 53 of the banknote handling apparatus 51.

In the banknote handling apparatus 51 shown in FIG. 6, a depositing process is performed as follows. An operator puts a batch of banknotes into the reception unit 11 of the banknote handling apparatus 51, and presses down the start button disposed on the operation unit 31. Then, the banknotes are fed out, one by one, from the reception unit 11 to the upper transport unit 10, and the upper transport unit 10 transports the banknotes. The banknotes transported by the upper transport unit 10 are recognized by the recognition unit 13 for a denomination, an authenticity, a fitness and so on. A banknote, which has been recognized as a normal banknote by the recognition unit 13, is stored in the storing and feeding unit 72*a* to 72*d* corresponding to the denomination. When the denomination of the banknote, which has been recognized as a normal banknote by the recognition unit 13, differs from the denominations of the respective storing and feeding units 72*a* to 72*d*, the banknote is transported to the collecting cassette 23 so as to be stored in the collecting cassette 23. In this manner, a banknote whose denomination is other than the denominations of the storing and feeding units 72*a* to 72*d* can be deposited but cannot be dispensed. On the other hand, a banknote, which has been recognized as a counterfeit banknote by the recognition unit 13, is transported to the capture bin 24. A banknote, which could not be recognized by the recognition unit 13, is transported as a reject banknote by the upper transport unit 10 to the dispensing unit 12. Then, the reject banknote is taken out by the operator from the dispensing unit 12. After all the banknotes put into the reception unit 11 have been fed out, the depositing process in the banknote handling apparatus 51 is finished.

In the banknote handling apparatus 51 shown in FIG. 6, a dispensing process is performed as follows. If the stored-number recorded in the memory unit 32 is larger than the designated-number of banknotes of each denomination in a dispensing command, a banknote is fed out from the storing and feeding unit 72*a* to 72*d* corresponding to the designated denomination, and the banknote is transported to the dispensing unit 12. At this time, transport of a banknote from the storing and feeding unit 72*a* to 72*d* to the dispensing unit 12 is performed until the number of banknotes of the designated denomination, which have been transported to the dispensing unit 12, reaches the designated-number in the dispensing command. On the other hand, if the designated denomination in the dispensing command is different from the denominations of the storing and feeding units 72*a* to 72*d*, or if the stored-number recorded in the memory unit 32 is smaller than the designated-number, a banknote is fed out from the reception unit 11, and the fed-out banknote is recognized by the recognition unit 13. If a denomination of the recognized banknote is the designated denomination, this banknote is transported to the dispensing unit 12. Such an operation is performed until the number of banknotes of the designated denomination, which have been transported to the dispensing unit 12, reaches the designated-number in the dispensing command. On the other hand, if the denomination of the banknote recognized by the recognition unit 13 is not the designated denomination, the banknote is sent to one storing and feeding unit (e.g., storing and feeding unit 72*a*) out of the four storing and feeding units 72*a* to 72*d* so as to be temporarily stored in the one storing and feeding unit 72*a*. In this manner, the dispensing process in the banknote handling apparatus 51 is performed. After the dispensing process in the banknote handling apparatus 51 has been finished and banknotes have been taken out from the dispensing unit 12, the banknote temporarily stored in the one storing and feeding unit 72*a* is fed out from the storing and feeding unit 72*a*, and is transported to the dispensing unit 12, whereby the banknote is returned to the operator.

Similarly to the banknote handling apparatus 1 shown in FIGS. 1 to 3, in the banknote handling apparatus 51 shown in FIG. 6, the memory unit 32 is configured to record the stored-number of banknotes stored in the banknote handling apparatus 51 by denomination. Upon receipt of a command for dispensing a banknote(s) of one or more denominations, the number of dispensing being designated by denomination, the control unit 30 compares the designated-number with the stored-number recorded in the memory unit 32 corresponding to the denomination designated in the dispensing command. When the stored-number is smaller than the designated-number, a banknote is fed out from the reception unit 11, and is recognized by the recognition unit 13. Then, a banknote of the designated denomination is transported to the dispensing unit 12, so that the number of banknotes of the designated denomination, which have been transported to the dispensing unit 12, matches the designated-number. According to such a banknote handling apparatus 51, when the number of banknotes of a designated denomination in a dispensing command is larger than the number of banknotes of this designated denomination, which are stored in the banknote handling apparatus 51, there is performed an immediate replenishing and dispensing operation in which a banknote, which has been replenished from outside the banknote handling apparatus 51 (a banknote which has been put into the reception unit 11), is directly dispensed. Therefore, as compared with a case in which a general banknote replenishing operation is performed when a banknote to be dispensed falls short, a waiting time of an operator can be reduced. This is because, due to the aforementioned method, a replenishing process and a dispensing process can be performed in the same step. In addition, according to the above banknote handling apparatus 51, since the number of all the banknotes transported to the dispensing unit 12 is counted by the recognition unit 13 of the banknote handling apparatus 51, it can be prevented that account data about a counted result and an actual money amount of the banknotes differ from each other.

Second Embodiment

Next, a second embodiment of the present invention is described herebelow. In a banknote handling apparatus in the second embodiment, a memory unit is configured to record a denomination of a banknote which can be stored in the banknote handling apparatus. In a dispensing process, a control unit performs the following control, which is different from the first embodiment. Namely, upon receipt of a dispensing command for dispensing a banknote(s) whose number is designated, a denomination of the banknote being different from the denomination of a banknote allowed to be stored, a banknote is fed out from a reception unit, and is recognized by a recognition unit. Then a banknote of the designate denomination is transported to a dispensing unit.

The banknote handling apparatus in the second embodiment is described with the use of the banknote handling apparatus 51 shown in FIG. 6.

In the banknote handling apparatus 51 in the second embodiment, the memory unit 32 is configured to record a denomination of a banknote allowed to be dispensed from the banknote handling apparatus 51. More specifically, the memory unit 32 is configured to record the denominations (four denominations) of the respective storing and feeding units 72*a* to 72*d*. As described above, banknotes are stored by denomination in the storing and feeding units 72*a* to 72*d*.

Figure 7:
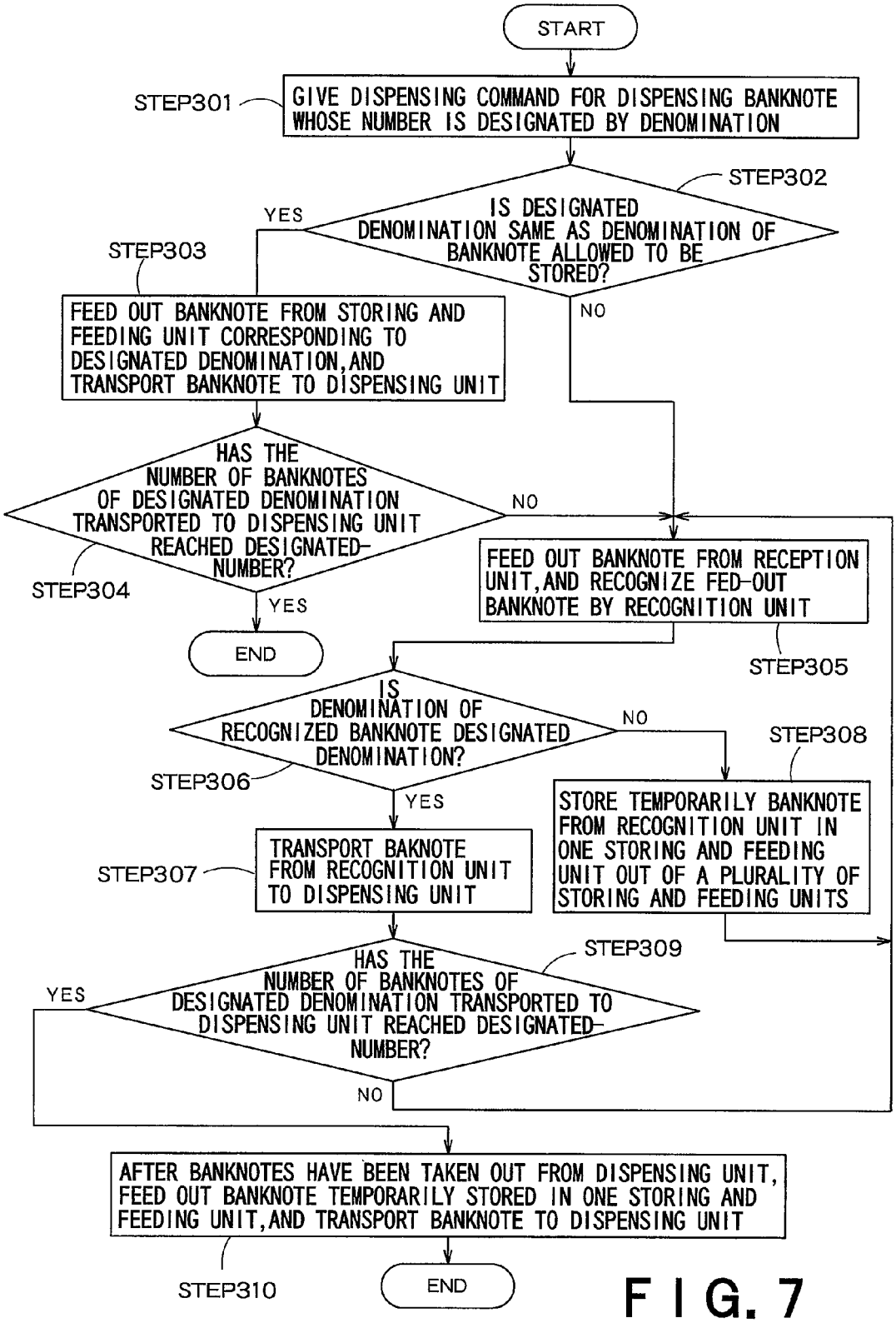
FIG. 7 is a flowchart showing a banknote dispensing process in a second embodiment in the banknote handling apparatus shown in FIG. 6.

Next, a dispensing process in the banknote handling apparatus 51 in the second embodiment is described with the use of a flowchart shown in FIG. 7.

At first, an operator gives a dispensing command to the control unit 30 through the operation unit 31. Specifically, the operator designates, as to banknotes to be dispensed of one or more denominations, the number of banknotes to be dispensed by denomination (STEP 301). Similarly to the first embodiment, in the dispensing command, a denomination of a banknote to be dispensed or a sum of a banknote to be dispensed may be designated, instead of designating the number of banknotes by denomination. Then, when the operator presses down the start button disposed on the operation unit 31, the control unit 30 judges, as to each denomination in the dispensing command, whether the denomination is the same or not as the denomination of a banknote allowed to be stored, which is recorded in the memory unit 32 (STEP 302). If the designated denomination in the dispensing command is the same as the denomination of the banknote allowed to be stored ("YES" in STEP 302), a banknotes is fed out, one by one, from the storing and feeding unit 72*a* to 72*d* corresponding to the designated denomination, and the fed-out banknote is transported to the dispensing unit 12 (STEP 303). Such an operation is performed until the number of banknotes of the designated denomination, which have been transported to the dispensing unit 12, reaches the designated-number. As to each denomination of a banknote to be dispensed in the dispensing command, if the number of banknotes of the designated denomination, which have been transported to the dispensing unit 12, reaches the designated-number ("YES" in STEP 304), the banknote dispensing process is finished. On the other hand, if all the banknotes are fed out from the storing and feeding unit 72*a* to 72*d* corresponding to the designated denomination but the number of banknotes of the designated denomination, which have been transported to the dispensing unit 12, does not reach the designated-number ("NO" in STEP 304), a banknote received in the reception unit 11 is regarded as a replenishing banknote, and the banknote is used as a banknote to be dispensed in the dispensing process (STEP 305).

When the designated denomination in the dispensing command is not the denomination of a banknote allowed to be stored, which is recorded in the memory unit 32 ("NO" in STEP 302), a banknote received in the reception unit 11 is regarded as a replenishing banknote, and the banknote is used as a banknote to be dispensed in the dispensing process.

In the above case, the display unit 33 displays a message to the operator, which promotes putting of banknotes into the reception unit 11. Then, the operator puts banknotes into the reception unit 11, and the operator presses down the start button disposed on the operation unit 31. Then, the banknotes are fed out, one by one, from the reception unit 11, and the fed-out banknotes are recognized by the recognition unit (STEP 305). If a denomination of the recognized banknote is the designated denomination ("YES" in STEP 306), the banknotes is transported from the recognition unit 13 to the dispensing unit 12 (STEP 307). On the other hand, if the denomination of the recognized banknote is not the designated denomination ("NO" in STEP 306), the banknote is transported from the recognition unit 13 to one storing and feeding unit (e.g., storing and feeding unit 72*a*) out of the four storing and feeding units 72*a* to 72*d* so as to be temporarily stored in the one storing and feeding unit 72*a* (STEP 308). At this time, a banknote, which has been recognized as a reject banknote by the recognition unit 13, is also temporarily stored in the one storing and feeding unit 72*a*. Then, if the number of banknotes of the designated denomination, which have been transported to the dispensing unit 12, reaches the designated-number ("YES" in STEP 309), the banknote dispensing process is finished.

After the banknote dispensing process has been finished and the dispensed banknotes have been taken out from the dispensing unit 12, the banknotes temporarily stored in the one storing and feeding unit 72*a* (banknotes other than the banknotes of the designated denomination, which have been fed out from the reception unit 11) are fed out, one by one, from the one storing and feeding unit 72*a*, and are transported to the dispensing unit 12 (STEP 310), so that the banknotes are returned to the operator.

If all the banknotes are fed out from the reception unit 11 and a banknote of the designated denomination out of the fed-out banknotes is transported to the dispensing unit 12 but the number of banknotes of the designated denomination, which have been transported to the dispensing unit 12, does not reach the designated-number, the display unit 33 displays a message informing this. In addition, the display unit 33 displays a message to the operator, which promotes further putting of a banknote(s) into the reception unit 11.

According to the banknote handling apparatus 51 in this embodiment, the memory unit 32 is configured to record a denomination of a banknote allowed to be stored in the banknote handling apparatus 51. Upon receipt of a command for dispensing a banknote(s) of a denomination different from the denomination of a banknote allowed to be stored, with the number thereof being designated ("NO" in STEP 302), the control unit 30 is configured to perform the following control. Namely, a banknote is fed out from the reception unit 11, and is recognized by the recognition unit 13 (STEP 305). Then, a banknote of the designated denomination is transported to the dispensing unit 12 (STEP 307), so that the number of banknotes of the designated denomination, which have been transported to the dispensing unit 12, matches the designated-number ("YES" in STEP 309). According to such a banknote handling apparatus 51, if the designated denomination of a banknote to be dispensed in the dispensing command differs from the denomination of a banknote allowed to be stored in the banknote handling apparatus 51, there is performed an immediate replenishing and dispensing operation in which a banknote, which has been replenished from outside the banknote handling apparatus 51 (a banknote which has been put into the reception unit 11), is directly dispensed. Therefore, as compared with a case in which a general banknote replenishing operation is performed when a banknote to be dispensed falls short, a waiting time of an operator can be reduced. This is because, due to the aforementioned method, a replenishing process and a dispensing process can be performed in the same step. In addition, according to the above banknote handling apparatus 51, since the number of all the banknotes transported to the dispensing unit 12 is counted by the recognition unit 13 of the banknote handling apparatus 51, it can be prevented that account data about a counted result and an actual money amount of the banknotes differ from each other.

In addition, in the banknote handling apparatus 51 in this embodiment, upon receipt of a dispensing command, when a banknote is fed out from the reception 11 and is recognized by the recognition unit 13 (STEP 305), the control unit 30 is configured to perform the following control. Namely, a banknote whose denomination is other than the designated denomination is stored in the storing and feeding unit (e.g., one storing and feeding unit 72*a* out of the four storing and feeding units 72*a* to 72*d*) (STEP 308). After the dispensing process has been finished, the banknote whose denomination is other than the designated denomination, which is stored in the storing and feeding unit (one storing and feeing unit 72*a*), is transported to the dispensing unit 12 (STEP 310). Thus, since a banknote (including a reject banknote) whose denomination is other than the designated denomination, out of the banknotes fed out from the reception unit 11, is transported to the dispensing unit 12, the banknote can be returned to the operator. In addition, a banknote whose denomination is other than the designated denomination, out of the banknotes fed out from the reception unit 11, may be directly stored in the storing and feeding unit. Alternatively, the banknote may be stored in the collecting cassette 23.

The invention claimed is:

1. A banknote handling apparatus that carries out at least a dispensing process comprising:

a reception unit configured to receive a banknote and to feed out the banknote one by one;

a transport unit configured to transport the banknote fed out from the reception unit;

a recognition unit disposed on the transport unit, the recognition unit being configured to recognize at least a denomination of the banknote transported by the transport unit;

an escrow unit connected to the transport unit and configured to temporarily store one or more banknotes that are transported by the transport unit;

a storing and feeding unit connected to the transport unit, the storing and feeding unit being configured to store the banknote that has been transported from the transport unit, and to feed out the stored banknote, one by one, to the transport unit;

a dispensing unit connected to the transport unit, the dispensing unit being configured to stack the banknote that has been transported from the transport unit, and to enable an operator to take out the banknote;

a memory unit configured to record the stored-number of banknotes stored in the banknote handling apparatus by denomination; and a control unit configured to, upon receipt of a command for dispensing a banknote of one or more denominations, where the number of banknotes to be dispensed is designated for each denomination, compare the designated-number with the stored-number recorded in the memory unit corresponding to the denomination designated in the dispensing command, and to control the storing and feeding unit, the reception unit, the escrow unit and the transport unit such that, if the stored-number is smaller than the designated-number, one or more banknotes of the designated denomination are fed out from the storing and feeding unit and transported to the dispensing unit, and if the number of banknotes of the designated denomination that have been fed out is still less than the designated-number, the control unit judges whether the one or more banknotes temporarily stored at the escrow unit are of the designated denomination, such that an escrowed banknote of the designated denomination is fed out from the escrow unit and transported to the dispensing unit, and if the number of banknotes of the designated denomination that have been fed out is still less than the designated-number, one or more banknotes are fed out from the reception unit to the recognition unit to be recognized, whereupon one or more banknotes recognized as the designated denomination whose number corresponds to a difference from the designated-number are transported to the dispensing unit, whereby the number of banknotes for each designated denomination that has been transported to the dispensing unit matches the designated-number for each denomination.

2. The banknote handling apparatus according to claim 1, wherein:

the storing and feeding unit includes a plurality of storing and feeding units configured to store banknotes by denomination; and the stored-number of banknotes to be recorded by denomination in the memory unit is the number of banknotes stored in the storing and feeding unit corresponding to the denomination.

3. The banknote handling apparatus according to claim 1, wherein:

the storing and feeding unit includes a plurality of storing and feeding units configured to store banknotes by denomination, and a storing and feeding unit of mixed denominations configured to store banknotes of a plurality of denominations in a mixed state; and the stored-number of banknotes to be recorded by denomination in the memory unit is a total sum of the number of banknotes stored in the storing and feeding unit corresponding to the denomination, and the number of banknotes of the corresponding denomination stored in the storing and feeding unit of mixed denominations.

4. The banknote handling apparatus according to claim 1, wherein:

a banknote to be sent to the dispensing unit upon receipt of the dispensing command is a banknote of the designated denomination that is stacked in the reception unit.

5. The banknote handling apparatus according to claim 1, wherein after the number of banknotes of the designated denomination that had been transported to the dispensing unit has matched the designated-number, the control unit is configured to return a banknote received by the reception unit.

6. The banknote handling apparatus according to claim 1, wherein after the number of banknotes of the designated denomination that are transported to the dispensing unit matches the designated-number, the control unit is configured to feed out a banknote received by the reception unit, to recognize the banknote by the recognition unit, and to store the banknote in the storing and feeding unit.

7. A banknote handling apparatus that carries out at least a dispensing process comprising:

a reception unit configured to receive a banknote and to feed out the banknote one by one;

a transport unit configured to transport the banknote fed out from the reception unit;

a recognition unit disposed on the transport unit, the recognition unit being configured to recognize at least a denomination of the banknote transported by the transport unit;

an escrow unit connected to the transport unit and configured to temporarily store one or more banknotes that are transported by the transport unit;

a storing and feeding unit connected to the transport unit, the storing and feeding unit being configured to store the banknote that has been transported from the transport unit, and to feed out the stored banknote, one by one, to the transport unit;

a dispensing unit connected to the transport unit, the dispensing unit being configured to stack the banknote that has been transported from the transport unit, and to enable an operator to take out the banknote;

a memory unit configured to record a denomination of a banknote allowed to be stored in the banknote handling apparatus; and a control unit configured to control the storing and feeding unit, the reception unit, the escrow unit, and the transport unit, wherein upon receipt of a command for dispensing banknotes of two or more denominations, such that the number of banknotes to be dispensed is designated for each denomination, and the denomination of the banknote to be dispensed is different from the denomination of a banknote allowed to be stored, the designated-number of banknotes for each denomination whose denomination is allowed to be stored are fed out from the storing and feeding unit and transported to the dispensing unit, one or more banknotes whose denomination is different from the denomination allowed to be stored are fed out from the escrow unit during the dispensing process and transported to the dispensing unit, and one or more banknotes whose denomination is different from the denomination allowed to be stored are fed out from the reception unit during the dispensing process and are recognized by the recognition unit, and the designated-number of banknotes that are recognized as the denomination designated in the dispensing command are transported to the dispensing unit, in order that the number of banknotes for each designated denomination that have been transported to the dispensing unit matches the designated-number for each denomination.

8. The banknote handling apparatus according to claim 7, wherein when a banknote is fed out from the reception unit and recognized by the recognition unit upon receipt of the dispensing command, the control unit is configured to store a banknote whose denomination is other than the designated denomination in the feeding and storing unit, and to transport the banknote whose denomination is other than the designated denomination stored in the storing and feeding unit, to the dispensing unit, after the dispensing process has been finished.

9. A banknote handling method that carries out at least a dispensing process comprising:

a reception step of receiving a banknote;

a feeding out step of feeding out the banknote one by one;

a transport step of transporting the banknote fed out at the reception step;

a recognition step of recognizing at least a denomination of the banknote transported at the transport step;

an escrowing step of temporarily storing one or more banknotes that are transported by the transport unit;

a storing and feeding step of storing the banknote that has been transported at the transport step, and feeding out the stored banknote, one by one;

a dispensing step of stacking the banknote that has been transported, and of enabling an operator to take out the banknote;

a memory step of recording the stored-number of banknotes stored by denomination; and a control step of, upon receipt of a command for dispensing a banknote of one or more denominations, where the number of banknotes to be dispensed is designated for each denomination, comparing the designated-number with the stored-number recorded at the memory step corresponding to the denomination designated in the dispensing command, and of controlling the storing and feeding step, the reception step, the escrowing step and the transport step such that, if the stored-number is smaller than the designated-number, one or more banknotes of the designated denomination are fed out at the storing and feeding step and transported, and if the number of banknotes of the designated denomination that have been fed out is still less than the designated-number, the control step judges whether the one or more banknotes temporarily stored at the escrow step are of the designated denomination, such that an escrowed banknote of the designated denomination is fed out from the escrow step and transported to the dispensing step, and if the number of banknotes of the designated denomination that have been fed out is still less than the designated-number, one or more banknotes are fed out at the reception step and are recognized at the recognition step, whereupon one or more banknotes recognized as the designated denomination whose number corresponds to a difference from the designated-number are transported, whereby the number of banknotes for each designated denomination that have been transported matches the designated-number for each denomination, wherein the banknote in the reception unit is regarded as a replenishment banknote if every banknote escrowed in the escrow unit is fed out.

10. A banknote handling method that carries out at least a dispensing process comprising:

a reception step of receiving a banknote and feeding out the banknote one by one;

a transport step of transporting the banknote fed out at the reception step;

a recognition step of recognizing at least a denomination of the banknote transported at the transport step;

an escrowing step of temporarily storing one or more banknotes that are transported by the transport unit;

a storing and feeding step of storing the banknote that has been transported at the transport step, and feeding out the stored banknote, one by one;

a dispensing step of stacking the banknote that has been transported, and of enabling an operator to take out the banknote;

a memory step of recording a denomination of a banknote allowed to be stored; and a control step of controlling the storing and feeding step, the reception step, the escrowing step and the transport step, wherein upon receipt of a command for dispensing banknotes of two or more denominations, such that the number of banknotes to be dispensed is designated for each denomination, and the denomination of the banknote to be dispensed is different from the denomination of a banknote allowed to be stored, the designated-number of banknotes for each denomination whose denomination is allowed to be stored are fed out at the storing and feeding step and transported, one or more banknotes whose denomination is different from the denomination allowed to be stored are fed out at the escrowing step during the dispensing process and transported, and one or more banknotes whose denomination is different from the denomination allowed to be stored are fed out at the reception step during the dispensing process and are recognized at the recognition step, and the designated-number of banknotes that are recognized as the denomination designated in the dispensing command are transported, in order that the number of banknotes for each designated denomination that have been transported matches the designated-number for each denomination.

* * * * *